US006499953B1

(12) United States Patent
Bellerose et al.

(10) Patent No.: US 6,499,953 B1
(45) Date of Patent: Dec. 31, 2002

(54) DUAL FLOW IMPELLER

(75) Inventors: Michel Bellerose, Boucherville (CA); Isabelle Bacon, Longueuil (CA); Ronald Francis Trumper, St. Bruno (CA)

(73) Assignee: Pratt & Whitney Canada Corp., Longueuil (CA)

( * ) Notice: Subject to any disclaimer, the term of this patent is extended or adjusted under 35 U.S.C. 154(b) by 1 day.

(21) Appl. No.: 09/672,817

(22) Filed: Sep. 29, 2000

(51) Int. Cl.[7] ..... B64C 27/32
(52) U.S. Cl. ..... 416/175
(58) Field of Search ..... 416/198 A, 198 R, 416/175, 194, 196 R, 181, 183

(56) References Cited

U.S. PATENT DOCUMENTS

| | | | | | |
|---|---|---|---|---|---|
| 1,258,462 | A | * | 3/1918 | Rice | 416/183 |
| 2,399,852 | A | | 5/1946 | Campbell et al. | |
| 2,469,125 | A | * | 5/1949 | Miesser | 416/183 |
| RE27,038 | E | * | 1/1971 | Newland | 416/181 |
| 3,642,383 | A | * | 2/1972 | Andvig | 416/183 |
| 3,904,308 | A | | 9/1975 | Ribaud | |
| 3,927,952 | A | * | 12/1975 | Kirby | 416/181 |
| 3,958,905 | A | * | 5/1976 | Wood | 416/183 |
| 4,125,344 | A | * | 11/1978 | Tiefenbacher | 416/183 |
| 4,152,816 | A | | 5/1979 | Ewing et al. | |
| 4,183,719 | A | * | 1/1980 | Bozung | 416/183 |
| 4,270,256 | A | | 6/1981 | Ewing | |
| 4,529,452 | A | | 7/1985 | Walker | |
| 4,581,300 | A | | 4/1986 | Hoppin, III et al. | |
| 4,587,700 | A | | 5/1986 | Curbishley et al. | |
| 4,659,288 | A | | 4/1987 | Clark et al. | |
| 4,784,572 | A | | 11/1988 | Novotny et al. | |
| 4,787,821 | A | * | 11/1988 | Cruse et al. | 416/185 |
| 4,796,343 | A | | 1/1989 | Wing | |
| 5,161,950 | A | | 11/1992 | Krueger et al. | |
| 5,297,723 | A | | 3/1994 | Benn et al. | |
| 5,390,413 | A | | 2/1995 | Pratt | |
| 5,593,085 | A | | 1/1997 | Tohill et al. | |
| 5,950,308 | A | | 9/1999 | Koff et al. | |

FOREIGN PATENT DOCUMENTS

| | | |
|---|---|---|
| EP | 615 810 A2 | 9/1994 |
| FR | 1022176 | 3/1953 |
| GB | 1515296 | 6/1978 |
| GB | 2059819 | 4/1981 |
| JP | 57-97883 | 6/1982 |
| JP | 1-205889 | 8/1989 |

* cited by examiner

*Primary Examiner*—Edward K. Look
*Assistant Examiner*—Igor Kershteyn
(74) *Attorney, Agent, or Firm*—Pratt & Whitney Canada Corp.; Todd D. Bailey

(57) ABSTRACT

A multi-stage compressor rotor for a gas turbine engine comprises an axial-flow rotor followed by a centrifugal rotor. The axial-flow rotor and the centrifugal rotor are diffusion bonded together to form a unitary dual flow impeller having blades with continues axial-flow and centrifugal stage sections. By eliminating the gap between the axial flow and centrifugal stages, unsynchronized air deflection between the successive arrays of blades is prevented, thereby improving the aerodynamic performance of the compressor rotor.

19 Claims, 1 Drawing Sheet

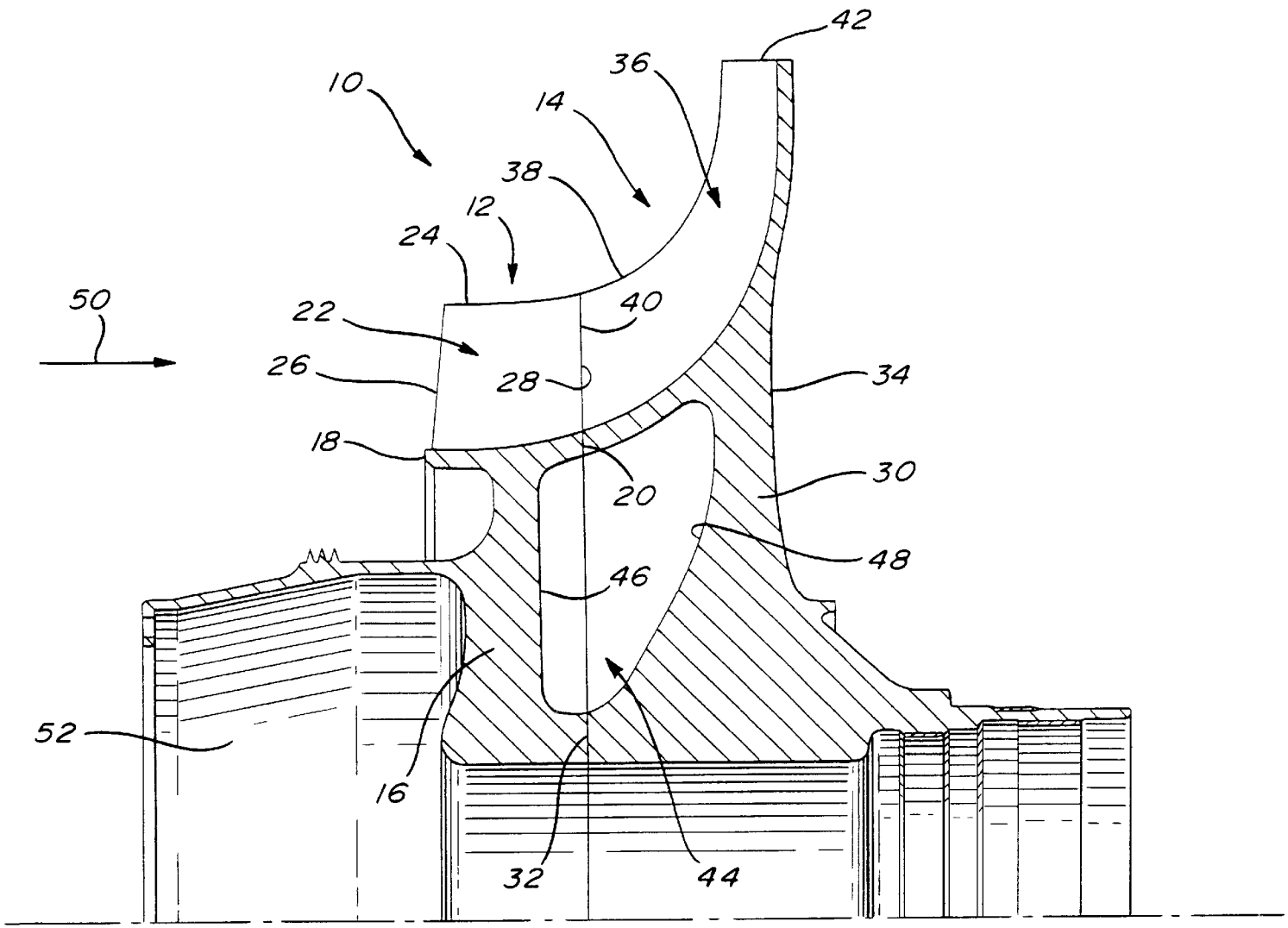
42
36
14
38
10
12
24
22
26
18
20
40
28
34
30
48
46
44
32
16
50
52

DUAL FLOW IMPELLER

BACKGROUND OF THE INVENTION

1. Field of the Invention

The present invention relates to compressors and, more particularly, to a multi-stage compressor rotor for a gas turbine engine.

2. Description of the Prior Art

Multi-stage compressors having an axial-flow stage followed by a centrifugal stage are known in the art. Such multi-stage compressors typically comprise an axial-flow rotor and a centrifugal rotor or impeller having respective disc-like portions connected to each other by means of bolts or the like. The axial-flow rotor and the centrifugal rotor are formed separately and then connected to each other with an axial gap between respective arrays of circumferentially spaced-apart blades thereof. The forging required to form the axial-flow rotor and the centrifugal rotor is considerable and the axial gap between their respective arrays of blades might result in unsynchronized deflection as the air passes from one stage to the next and, thus, adversely affect the overall aerodynamic performance of the multi-stage compressor.

Therefore, there is a need for a new multi-stage compressor rotor requiring less forging while having improved aerodynamic performances.

SUMMARY OF THE INVENTION

It is therefore an aim of the present invention to provide a new multi-stage compressor rotor having improved aerodynamic performance.

It is also an aim of the present invention to improve the growth potential of a compressor rotor.

It is a further aim of the present invention to provide a multi-stage compressor rotor of relatively light weight construction.

It is a still further aim of the present invention to provide a multi-stage compressor which is relatively simple and economical to manufacture.

Therefore, in accordance with the present invention, there is provided a multi-stage compressor rotor for a gas turbine engine, comprising an axial-flow rotor followed by a centrifugal rotor, said axial-flow rotor and said centrifugal rotor being bonded together to form a unitary dual flow impeller having blades with united axial-flow and centrifugal stage sections.

In accordance with a further general aspect of the present invention, there is provided a multi-stage compressor rotor for a gas turbine engine, comprising an axial-flow rotor followed by a centrifugal rotor, said axial-flow rotor and said centrifugal rotor being provided with respective arrays of circumferentially spaced-apart blades, wherein each blade of said centrifugal rotor extends in continuity from a corresponding blade of said axial-flow rotor to a discharge edge thereof.

In accordance with another general aspect of the present invention, there is provided a dual flow impeller for a gas turbine engine, comprising a disc-like member having front and rear sections bonded together, an array of circumferentially spaced-apart blades defined in said front and rear sections, each said blade having a continuous blade profile including an axial-flow inducing stage section followed by a centrifugal-flow stage section.

BRIEF DESCRIPTION OF THE DRAWINGS

Having thus generally described the nature of the invention, reference will now be made to the accompanying drawing, showing by way of illustration a preferred embodiment thereof, and in which:

FIG. 1 is a fragmentary longitudinal cross-sectional view of one half of a multi-stage compressor rotor having an axial-flow rotor and a centrifugal rotor diffusion bonded together in accordance with a preferred embodiment of the present invention.

DESCRIPTION OF THE PREFERRED EMBODIMENTS

Now referring to FIG. 1, a multi-stage compressor rotor 10 for use in a gas turbine engine will be described. The multi-stage compressor rotor 10 generally comprises an axial-flow rotor 12 followed by a centrifugal rotor 14. The axial-flow rotor 12 provides a first compression stage, whereas the centrifugal rotor 14 provides a second compression stage for further compressing the air received from the first compression stage. As will be explained hereinafter, the axial-flow rotor 12 and the centrifugal rotor 14 are intimately united or combined by a diffusion bonding process to form a unitary dual flow impeller, as depicted in FIG. 1.

The axial-flow rotor 12 comprises a disc-like annular body 16 adapted to be mounted on a shaft for rotation therewith. The disc-like annular body 16 has a front or inducer end 18 and an opposite rear end surface 20. An array of circumferentially spaced-apart blades 22 (only one being shown in FIG. 1) extend radially outwardly from the disc-like annular body 16. Each blade 22 has a tip edge 24 extending between a leading edge 26 and a trailing edge 28.

The centrifugal rotor 14 comprises a disc-like annular body 30 adapted to be mounted on the same shaft as the disc annular body 16 for conjoint rotational movement therewith. The disc-like annular body 30 has a front end surface 32 and an opposite read end surface 34. An array of circumferentially spaced-apart blades 36 (only one being shown in FIG. 1) extend radially outwardly from the disc-like annular body 30, the number of centrifugal compressor blades 36 matching the number of axial-flow compressor blades 22. Each blade 36 has a curved tip edge 38 extending between a leading edge 40 and a discharge edge 42.

As shown in FIG. 1, the front end surface 32 of the centrifugal rotor 14 is bonded to the rear end surface 20 of the axial-flow rotor 12 with the leading edge 40 of each centrifugal compressor blade 36 bonded to the trailing edge 28 of a corresponding axial-flow compressor blade 22. This could be done by hot isostatically pressing the axial-flow rotor 12 and the centrifugal rotor 14 together so as to achieve diffusion bonding across the interface defined by the bondable surface formed by the trailing edges 28 of the blades 22 and the rear end surface 20 of the axial-flow rotor 12 and the complementary bondable surface formed by the leading edges 40 of the blades 36 and the front end surface 32 of the centrifugal rotor 14.

By so bonding the blades 22 to the blades 36, the gap normally existing between such two stages of blades is eliminated, which advantageously prevents an unsynchronized air deflection as the air passes from one stage to the next. This leads to improvement in the overall aerodynamic performance of the multi-stage compressor rotor 10, as compared to conventional multi-stage compressor rotor. The improved aerodynamic performances also result in the reduction of the vibrations and the noise generated by the multi-stage compressor rotor 10 during operation thereof.

As shown in FIG. 1, a circumferentially extending cavity 44 is defined in the multi-stage compressor rotor 10 at the union of the axial-flow rotor 12 and the centrifugal flow rotor 14. The cavity 44 is formed by two complementary annular recesses 46 and 48 respectively defined in the rear surface 20 of the axial-flow rotor 12 and the front surface 32 of the centrifugal rotor 14. The cavity 44 contributes to reduce the weight of the multi-stage compressor rotor 10 and, thus, the inertia thereof, thereby improving the compressor rotor 10 operability margin. The cavity 44 also contributes to reduce the stress at the central bore 52 of the multi-stage compressor rotor 10. Finally, the cavity 44 facilitate and improved the diffusion bonding operation. Indeed, without the cavity 44, the bond would be larger, more expensive and would require tremendous process control. The provision of such a cavity would not be possible if the compressor rotor 10 was manufactured from a single piece of material. The multi-stage compressor rotor 10 can be manufactured by first providing two pre-forms, i.e. the pre-forged axial flow rotor 12 and the pre-forged centrifugal flow rotor 14 with roughly preformed blades 22 and 36. Then, the two pre-forms are intimately united by hot isostatic pressing so that the two parts become a one-piece body. After having completed the hot isostatic pressing operation, the resulting forging pre-form is machined to its final form, i.e. the multi-stage compressor rotor illustrated in FIG. 1.

By pre-bonding the annular disc bodies 16 and 30 together, the forging required to produce the final form is reduced, as compared to a conventional multi-stage compressor composed of distinct stages of compressor rotors. This is because each individual annular disc 16,30 has a reduced thickness as compared to a one-piece impeller having dimensions similar to the assembled compressor rotor 10. Therefore, the annular discs 16 and 30 can be more easily individually forged and then bonded together. This leads to a multi-stage compressor having better inherent mechanical properties and, thus, higher speed capabilities and improved burst margin. Furthermore, the reduction of the forging required to form the hot section of the multi-stage compressor rotor 10, i.e. the centrifugal rotor 14, contributes to improve the overall growth potential of the multi-stage compressor rotor 10, which is normally limited by the forging size of the hot section thereof. Furthermore, the reduction of the forging required to form the multi-stage compressor rotor 10 contributes to reduce its manufacturing cost.

Also, the machining time required to make the multi-stage compressor rotor 10 is less than the machining time normally required to make a conventional multi-stage compressor rotor where the axial compressor and the centrifugal compressor are two separate parts. Finally, by bonding the axial-flow rotor 12 and the centrifugal flow rotor 14 together, fewer components are required, reducing the manufacturing costs of the multi-stage compressor rotor 10 while at the same time improving the failure mode thereof.

The bonding of two parts advantageously allows to have a one piece body made of two different materials. Accordingly, less expensive material can be used for the axial-flow rotor 12 where high temperature properties are less critical.

Bolts (not shown) can be used as an additional fastening means for securing the axial-flow rotor 12 and the centrifugal rotor 14 together. In this case, the primary role of the bond between the axial-flow rotor 12 and the centrifugal rotor 14 is to enable the final machining of the blades 22 and 36. In addition to its manufacturing role, the bond can accomplish a critical structural role to retain the axial-flow rotor 12 and the centrifugal rotor 14 in an intimately united relationship.

In operation, the incoming air guided by the housing (not shown) surrounding the multi-stage compressor rotor 10 will first flow to the leading edge 26 of the first array of blades 22, as indicated by arrow 50. The air will pass from the blades 22 directly to the second array of blades 36 along the continuous surface provided by the first and second stages of blades, thereby preventing unsynchronized air deflection between the stages. The air will finally be discharged at the discharge ends 42 of the blades 36. According to another embodiment of the present invention, the disc bodies 20 and 30 are bonded together without the blades having been previously formed therein. Then, once the two disc bodies have been bonded together, the blades are machined into the bonded disc members 20 and 30 so as to form an array of circumferentially spaced-apart blades with continues axial and centrifugal sections.

What is claimed is:

1. An integral multi-stage compressor rotor for a gas turbine engine, comprising an axial-flow rotor portion followed by a centrifugal rotor portion, said portions having respective aligned arrays of blades integrally bonded together to form a unitary array of blades with united axial-flow and centrifugal stage sections, wherein a cavity is defined at an interface of said axial-flow rotor portion and said centrifugal rotor portion.

2. An integral multi-stage compressor rotor as defined in claim 1, wherein each said blade of said axial-flow rotor portion is bonded at a trailing edge thereof to a leading edge of a corresponding blade of said centrifugal rotor portion.

3. An integral multi-stage compressor rotor as defined in claim 2, wherein said axial-flow rotor portion and said centrifugal rotor portion are respectively provided with rear and front complimentarily bondable surfaces with radially extending bondable webs formed by said trailing edges and said leading edges of said blades of said axial-flow rotor portion and said centrifugal rotor portion, respectively.

4. An integral multi-stage compressor rotor as defined in claim 1, wherein said cavity is formed by a first recess defined in a rear bondable surface of said axial-flow rotor portion and a second complementary recess defined in a front bondable surface of said centrifugal rotor portion.

5. An integral multi-stage compressor rotor as defined in claim 4, wherein said cavity has a continuous annular configuration.

6. A multi-stage compressor rotor for a gas turbine engine, comprising an axial-flow rotor followed by a centrifugal rotor, said axial-flow rotor and said centrifugal rotor being provided with respective arrays of circumferentially spaced-apart blades, wherein each blade of said centrifugal rotor is integrally bonded to a corresponding blade of said axial-flow rotor so as to form an array of blades with united axial-flow and centrifugal stage sections, wherein a cavity is defined at an interface of said axial-flow rotor portion and said centrifugal rotor portion.

7. A multi-stage compressor rotor as defined in claim 6, wherein each said blade of said axial-flow rotor is bonded at a trailing edge thereof to a leading edge of a corresponding blade of said centrifugal rotor.

8. A multi-stage compressor rotor as defined in claim 6, wherein said axial-flow rotor and said centrifugal rotor are respectively provided with rear and front complimentarily bondable surfaces with radially extending bondable webs formed by said trailing edges and said leading edges of said blades of said axial-flow rotor and said centrifugal rotor, respectively.

9. A multi-stage compressor rotor as defined in claim 6, wherein said cavity is formed by a first recess defined in a rear surface of said axial-flow rotor and a second complementary recess defined in a front surface of said centrifugal rotor.

10. A dual flow impeller for a gas turbine engine, comprising a disc-like member having front and rear sections bonded together, an array of circumferentially spaced-apart blades defined in said front and rear sections, each said blade having a continuous blade profile including an axial-flow inducing stage section integrally bonded to a centrifugal-flow stage section, wherein a cavity is defined between said front and rear sections.

11. A dual flow impeller as defined in claim 10, wherein said front and rear sections are provided with complementary recesses at an interface thereof, said complementary recesses cooperating to define said cavity in said disc-like member.

12. A method of forming a compressor rotor for a gas turbine engine, the method comprising the steps of:

a) providing first and second rotor sections, each of said sections having a set of blades extending therefrom;

b) intimately uniting said first and second rotor sections to form an integral one-piece body, wherein the step includes intimately uniting blades in the set of blades on the first rotor section with corresponding blades in the set of blades on the second rotor, and c) shaping the one-piece body to a final form to yield a composite rotor with integral blades.

13. A method as defined in claim 12, wherein step a) comprises the steps of: defining said first set of blades in said first rotor section, and defining a second set of blades in said second rotor section, said second set of blades corresponding in number and position to said first set of blades so that said first and second sets of blades substantially abut when said first and second rotors are mated prior to being united.

14. A method as defined in claim 12, wherein the sections are intimately united by hot isostatic pressing.

15. A method as defined in claim 12, wherein step a) comprises the step of individually forging the first and second rotor sections.

16. A method as defined in claim 12, wherein step c) comprises the steps of machining said one-piece body.

17. A method as defined in claim 12, wherein the first and second rotor sections are composed of different materials.

18. A method as defined in claim 12, wherein trailing edges of said first set of blades is intimately united with leading edges of said second set of blades.

19. A method as defined in claim 12, wherein step a) comprises the steps of defining a first recess in a rear surface of said first rotor section, defining a second recess, complimentary of said first recess, in said second rotor section, and wherein step b) comprises the step of aligning said first and second recesses such that an enclosed cavity is formed when the first and second rotor sections are mated.

* * * * *